US005612000A

United States Patent [19]

Lemieux

[11] Patent Number: 5,612,000

[45] **Date of Patent: *Mar. 18, 1997**

[54] REFILL PACK FOR PIPETTE TIP RACKS

[75] Inventor: David J. Lemieux, Middleton, Mass.

[73] Assignee: Rainin Instrument Co., Inc., Emeryville, Calif.

[ * ] Notice: The portion of the term of this patent subsequent to Sep. 21, 2013, has been disclaimed.

[21] Appl. No.: 492,776

[22] Filed: Jun. 21, 1995

Related U.S. Application Data

[63] Continuation of Ser. No. 125,019, Sep. 21, 1993, Pat. No. 5,441,702.

[51] Int. Cl.[6] ..... B01L 3/02; B65D 1/34; B65D 55/00

[52] U.S. Cl. ..... 422/100; 422/104; 206/499; 206/503; 206/506; 206/507; 206/563

[58] Field of Search ..... 422/99, 100, 104; 206/562, 503, 486, 499, 506, 507, 563

[56] References Cited

U.S. PATENT DOCUMENTS

| | | | |
|---|---|---|---|
| 5,324,482 | 6/1994 | Scaramella et al. | 422/100 |
| 5,392,914 | 2/1995 | Lemieux et al. | 206/499 |
| 5,441,702 | 8/1995 | Lemieux et al. | 422/100 |

FOREIGN PATENT DOCUMENTS

| | | |
|---|---|---|
| 9201514 | 2/1992 | Germany . |

*Primary Examiner*—Long V. Le
*Attorney, Agent, or Firm*—Robert R. Meads

[57] ABSTRACT

A refill pack for storing and dispensing pipette tips into an empty tip rack. The refill rack comprises a hand-gripable carrier for an array of pipette tips releasably secured relative to the carrier such that after hand positioning the array of tips on the empty tip rack, the carrier may be released from the tips which are then free to be seated on a lower end of a pipette and removed from the tip rack.

4 Claims, 1 Drawing Sheet

REFILL PACK FOR PIPETTE TIP RACKS

RELATED PATENT APPLICATION

This application is a continuation of Ser. No. 08/125,019 filed Sep. 21, 1993, now U.S. Pat. No. 5,441,702.

FIELD OF INVENTION

The present invention relates to the refilling of pipette tip racks and, more particularly to a disposable refill pack of pipette tips for reusable pipette tip racks.

BACKGROUND OF THE INVENTION

It is the function of pipette tip racks to organize disposable pipette tips in a manner for convenient tip placement on a pipette. Such racks generally comprise a base with vertical sides joined at contiguous edges and containing supports for a rigid horizontal tray or support plate containing an array of holes for vertically receiving and supporting a horizontally spaced array of pipette tips. The pipette tips are held vertically in the array for ease of access by a pipette tip user. In this regard, the pipette tip user simply moves a hand-holdable pipette over the rack and lowers a distal end of the pipette into a proximal or upper end of a vertically oriented tip and presses down to affix the tip to the pipette. A similar operation is followed by the user when connecting a plurality of tips to a multiple tip pipette. U.S. Pat. No. 4,676,377 describes a conventional pipette tip rack of the type just described, and U.S. Pat. No. 4,779,467 describes a multiple tip pipette.

Once all tips are dispensed from the tip rack, the rack may be discarded or reloaded with a new supply of pipette tips. The reloading of disposable pipette tips into such tip racks in a rapid, convenient manner is important to pipette users. Further, any packaging containing pipette tips and for use in loading pipette tips into a tip rack should arrange the pipette tips in a manner to accommodate direct dispensing of the tips into standard tip rack arrangements. Moreover, it is important that such packaging protect the disposable pipette tips from damage and contamination during shipping, handling and storage and provide for sterilization by autoclaving or irradiation of the pipette tips. Still further, when plastic materials are utilized for such packaging, it is particularly important to the preservation of our environment (1) that the plastic material be recyclable and (2) that the packaging structure be thin, lightweight and of low mass to minimize the amount of non-biodegradable disposable material from such packaging. Furthermore, there is a need for refill packs for manually reloading reusable pipette tip racks with filter containing pipette tips such as the FilterPro of the Rainin Instrument Co., Inc., assignee of the present invention, or, such as the filter devices described in U.S. Pat. No. 5,156,811, assigned to Continental Laboratory Products, Inc. of San Diego, Calif.

Prior packaging used for stacks of pipette tip racks and for pipette tips for reloading empty pipette tip racks do not satisfy such requirements. For example, U.S. Pat. No. 3,853,217 describes a stack of stand-alone pipette tip racks, referred to in the patent as "trays". Each tray comprises a horizontally oriented rectangular support. The horizontal support contains transverse stiffening ribs. Each rib extends above the horizontal support and terminates in marginal vertical sides. The sides extend above and below the horizontal support and connect at their contiguous edges to form a skirt. The skirt extends below distal end portions of vertical pipette tips contained in a honeycomb array of openings in the horizontal surface. A shoulder is formed around the skirt so as to accept and support an identical upper tray to rest a lowermost edge of its skirt for stacking of the trays. The shoulder thereby spaces the upper tray so as to allow the distal end portion of the pipette tips in the upper tray to extend into the open proximal end of the pipette tips in the lower tray. Concentric positioning of the upper tips in the lower tips permits a nested stacking of multiple trays. A cover encloses the topmost tray in the stack. Tape is used to secure the cover and stacked trays; applied to fasten the cover and trays along common sides. Nested stacks of the trays with a cover are enclosed within a snug carton for shipping and storage. Additionally, folded sleeves are included in the shipping carton for covering a tray removed from the stack. The carton is provided with a pipette tip extractor for collecting used tips in the shipping carton. The trays are structurally rigid and with sufficient material thickness to be self supporting. The rigid trays are used individually and stored as stacked.

In use, the stacked trays with the cover taped in place are removed from the shipping carton. Individual trays are removed from the bottom of the stack by severing the tape attaching the lowest tray, leaving the upper trays attached and enclosed until the next bottom tray is to be used. The pipette tips are accessed individually from the tray, since the honeycomb arrangement does not accommodate multiple tip pipettes. Used pipette tips are disposed of in the shipping carton, using the tip extractor included. As each tray is emptied, it is discarded. Since the trays are intended for stand-alone use, their structure is necessarily heavy, with thick stiffening sections, containing a significant amount of plastic. Therefore, the heavy trays represent a significant environmental disposal problem. Further, the nesting of the trays with upper pipette tips extending into lower tips, precludes the use of the package of U.S. Pat. No. 3,853,217 for storage and dispensing of filter containing pipette tips.

In U.S. Pat. No. 3,937,322, a package containing a stack of trays of pipette tips is disclosed. Each tray comprises a horizontal rectangular support with an array of openings. The openings accept distal end portions of pipette tips and maintain their longitudinal axes in a vertical orientation. The trays are stacked in a carton by telescoping the pipette tips carried by an upper tray into the open upper ends of the pipette tips carried by the next lower tray and by resting a horizontal support lower surface of the upper tray on the upper edge of the pipette tips in the next lower tray. The lowermost tray in the stack is supported on a tray support extending vertically from a bottom of the carton. Also attached to the carton is a pipette tip extractor.

In use, the carton is opened at the top and uppermost pipette tip trays are exposed. The pipette tips are accessed from the open top of the carton and individually loaded onto pipettes. This is accomplished by pressing an end of a pipette into a tip to seat the tip thereon and then by removing the loaded pipette from the carton. When all the pipette tips on the uppermost tray have been thus dispensed from the tray, the tray is discarded, exposing the tips in the tray below. The pipette tip extractor is installed in a wall of the carton and permits a used tip to be extracted from the pipette and dropped into the carton without contact with the user. The carton is then used for disposal of used tips.

As described, the container of U.S. Pat. No. 3,937,322 is characterized by a number of shortcomings. Because of the telescoping of the pipette tips in the stack of trays, it is not possible to use the packaging of the '322 patent for the storage and dispensing of filter containing tips. Further, for one of the contained pipette tips to be accessible to a user for reloading of a pipette, substantially all the contained pipette tips are exposed to the atmosphere and hence subject to possible contamination. Finally, each tray is supported on the tops of the pipette tips in the next lower tray. Unless the trays and the bottom tray support are formed of relatively heavy, rigid plastic or equivalent material, the downward pressing of the pipette in loading a tip onto the shaft of a pipette will produce an undesired downward bowing of the trays. The bowing of the tray makes it difficult to insert a pipette tip onto the end of a pipette shaft. In the case of a multiple-tip pipette, only a small amount of bowing is required to prevent a user from being able to insert pipette tips simultaneously onto all shafts of the multiple-tip pipette simply by pressing down on the pipette. Rather, if the tray bows, a user must (i) check each tip individually in order to assure that all tips are properly secured to each pipette shaft and (ii) secure any loose tips individually by hand. With a heavier, more rigid rack support, such bowing will not occur. However, if the trays and the bottom tray support are formed of a heavy rigid plastic material to prevent such undesired bowing during the loading of pipettes, then the disposal of such trays will present an undesired increase in the disposal of non-biodegradable materials.

Prior commercially available packaging of stacks of nested pipette tip racks similar to the packaging disclosed by the U.S. Pat. No. 3,853,217 and possessing all the disadvantages thereof is represented by the RBR Packaging of Bio-Rad Laboratories, Inc. of Richmond, Calif. TBR Packaging comprising a stack of separate racks is also available from Bio-Rad Laboratories, Inc. In addition, USA/Scientific Plastics of Ocala, Fla. markets a RE-PACK RACK comprising a reusable pipette tip rack, designed to accept RE-PACK Tray Cartridges preloaded with 192 pipette tips per tray. Once a tray is empty, it is simply removed from the rack and discarded and another tray cartridge inserted in its place. The RE-PACK Tray Cartridges are formed of a rigid, relatively heavy plastic construction and, but for the transverse ribs, resemble and possess the disadvantages of the trays disclosed in U.S. Pat. No. 3,853,217. Such RE-PACK tray cartridges are available in shrink-wrapped stacks of 5 trays of 192 tips each.

From the foregoing, it should be appreciated that prior packages for pipette tip racks and trays do not satisfy the previously stated desired requirements for packaging for reloading of disposable pipette tips into reusable tip racks. Thus, there is a continuing need for such packaging which is satisfied by this present invention.

SUMMARY OF THE INVENTION

In its most basic form, the present invention provides a simple, light weight, low cost and disposable or recyclable refill pack for reusable pipette tip racks in which pipette tips are contained with their longitudinal axes vertically positioned in a horizontally spaced pattern or array. The refill pack comprises (i) a horizontally extending pipette tip organizing-and support plate, (ii) a light weight hand-gripable support plate carrier, and (iii) manually releasable means for dispensing pipette tips from the refill pack into an empty tip rack. The support plate includes an array of holes for vertically receiving and organizing pipette tips in a desired pattern for deposit into and containment within an empty tip rack. Distal end portions of the pipette tips extend vertically through the holes on one side of the support plate while proximal end portions of the pipette tips are supported by the plate on an opposite side thereof. The carrier is secured to the support plate and enables a user to manually move and position the support plate over an empty tip rack while the support plate maintains the horizontal spacing and vertical orientation of the pipette tips within the refill pack ready for dispensing into the tip rack upon a release of the tips from the refill pack. Thus, in use, a user hand grips the carrier and lifts and moves the array of pipette tips over and down onto the top of an empty tip rack until the distal ends of the pipette tips seat in an array of holes in a support tray of the tip rack. The user then releases the array of tips from the carrier readying the tips for seating on and pick up by a lower end of a pipette.

Preferred embodiments are presented setting forth details referred to and illustrated in the drawings described below. The variations of the invention hereinafter described may be packaged separately or with a pipette tip rack.

DESCRIPTION OF THE PREFERRED EMBODIMENT

The present invention provides a novel refill pack of disposable pipette tips for reusable pipette tip racks and may take any of a multiplicity of forms within the claims hereafter presented. Each embodiment may include or exclude a tip rack as part of the refill pack. Additionally, the materials for use in the present invention may be selected as appropriate for sterilization by autoclaving or irradiation and to permit recycling for minimizing detrimental environmental impact.

Figure 1A:
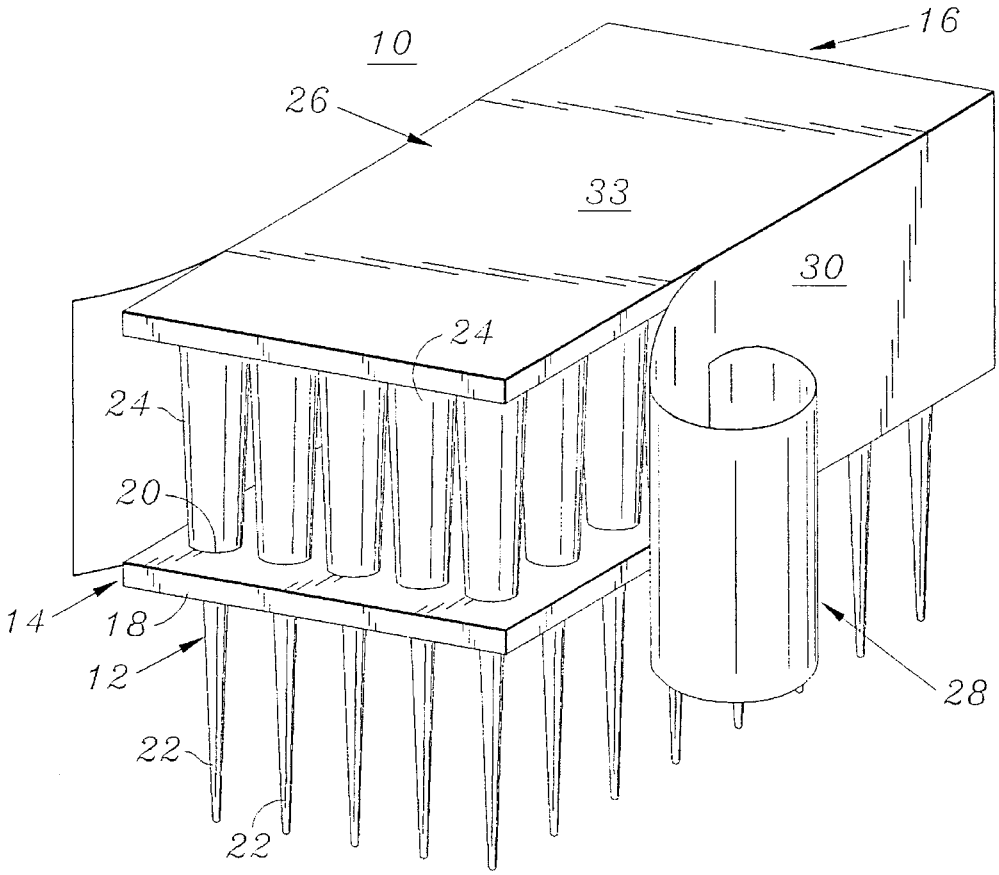
FIG. 1*a* is an isometric view of a basic and simple embodiment of a single array pipette tip refill pack showing the use of tape as releasable means for releasably securing a support plate for an array of pipette tips to a carrier comprising a cover or top plate for the array.

More particularly, a simplified form of a single array refill pack 10 is shown in FIG. 1*a* and comprises a pipette tip organizing means 14 for an array of pipette tips 12 in combination with a hand gripable carrier 16 for the organizing means 14.

As illustrated, the organizing means 14 comprises a semi-rigid plastic support plate 18 having an array of holes 20 for (i) receiving distal end portions 22 of the pipette tips 12 and (ii) organizing the pipette tips 12 into a horizontally spaced array. The array of pipette tips 12, which may comprise filter containing pipette tips, has distal end portions 22 extending perpendicularly through the holes 20 in the support plate 18 and proximal end portions 24 extending perpendicularly from the opposite surface of the support plate 18.

As also illustrated in the embodiment of FIG. 1*a*, the carrier 16 comprises a cover 26 secured by releasable means 28 to the support plate 18. The illustrated cover 26 comprises an alignment plate 33 which rests on and confines the proximal end portions 24 of the pipette tips 12 in combination with the support plate 18.

The releasable means 28 of FIG. 1*a* comprises a tape 30 of sufficient vertical dimension and length to extend between and around and to adhesively, thermally or mechanically attach to marginal edges of the support plate 18 comprising the organizing means 14 and marginal edges of the alignment plate 33 comprising the carrier 16.

To protect the distal end portions 22 of the array of pipette tips 12 and to complete the packaging for the refill pack 10, the refill pack may be enclosed by shrink wrap or within a pouch or other container or box of a thin light weight recyclable plastic or cardboard material. Then, in use, the refill pack is removed from the shrink wrap, pouch or box. Next, the user of the refill pack grips the alignment plate 33 comprising the carrier 16, moves the pack 10 over the top of any empty tip rack, and lowers the carrier to insert the distal end portions of the array of pipette tips 12 into the open top of the rack. He then releases the tape 30 to separate the carrier 16 from the array of pipette tips 12 as well as the support plate 18 which remain in the tip rack. Finally, the alignment plate 33 comprising the carrier is removed and may be recycled, as may the support plate after all of the pipette tips are dispensed from the tip rack.

Figure 1B:
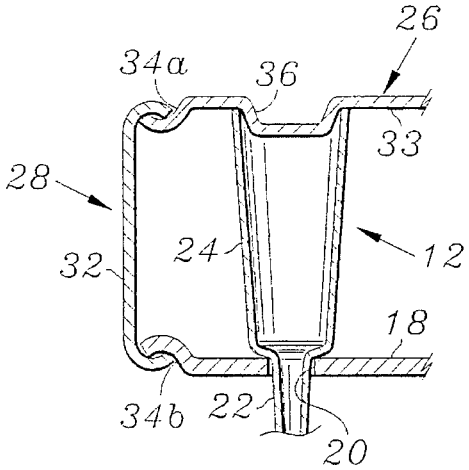
FIG. 1*b* is a partial section end view of the single array refill pack of FIG. 1*a* with the tape replaced by spring clips.

An alternate form of the refill pack 10 is shown in FIG. 1*b*. As illustrated, instead of comprising a length of tape, the releasable means 28 comprises plastic or metal spring clips 32 or other spring attachment means, releasably securing the carrier 16 and the support plate 18. In the illustrated alternative, the alignment plate 33 includes a downwardly extending marginal channel 34*a* formed so as to accept the spring clip 32 with its uppermost surface flush with the upper surface of the alignment plate 33. Similarly, to accept the lower portion of the spring clip 32, the support plate 18 contains an upwardly extending marginal channel 34*b* formed so as to retain the spring clip lowermost surface flush with the lower surface of the support plate 18.

In addition, in the alternative form of the refill pack illustrated in FIG. 1*b*, an array of frusto-conical projections 36 extend downwardly from a bottom of the alignment plate 33. The array of projections 36 correspond to and align vertically with the array of holes in the support plate 18 and define indexing means extending into and laterally constraining proximal end portions 24 of pipette tips 12 to maintain the longitudinal axes of the pipette tips 12 in a vertical orientation.

In use, the spring clips 32 releasably secure the support plate 18 relative to the alignment plate 33 whereby a manual positioning of the support plate 18 over a pipette tip rack 38 with the distal end portions 22 of the pipette tips 12 extending into the pipette tip rack 38 followed by a release of the spring clips and removal of the alignment plate 33 affects a refilling of the pipette tip rack.

From the foregoing description of the various preferred embodiments illustrated in the drawings, it should be appreciated that the present invention may take many various forms and that the present invention is to be limited only by the following claims.

I claim:

1. A refill pack for refilling an empty pipette tip rack, the refill pack comprising:

an organizing plate including an array of holes;

a plurality of pipette tips with distal end portions extending vertically through the array of holes in the organizing plate for support in a horizontally spaced array;

a carrier extending from the organizing plate for grasping by a user to hand position the organizing plate and the array of pipette tips in an empty pipette tip rack; and hand-releasable means securing the array of tips relative to the carrier for releasing the array of tips from the carrier for support with the organizing plate in the empty pipette tip rack.

2. The refill pack of claim 1 wherein the carrier comprises a cover for the pipette tips releaseably secured to the organizing plate by the hand-releasable means.

3. The refill pack of claim 1 wherein the carrier comprises a carrier plate releasably secured to the organizing plate by the hand-releasable means.

4. The refill pack of claim 3 wherein the hand-releasable means comprises means for (1) securing the organizing plate relative to the carrier plate and (2) selectively releasing the organizing plate and the array of pipette tips from the carrier plate to effect a refilling of the empty pipette tip rack.

* * * * *